US006997682B2

(12) United States Patent
Jung et al.

(10) Patent No.: US 6,997,682 B2
(45) Date of Patent: Feb. 14, 2006

(54) COOL AIR CIRCULATION TYPE AXIAL FLOW FAN FOR REFRIGERATOR

(75) Inventors: Young Gyu Jung, Kyungki-do (KR); Chang Joon Kim, Seoul-si (KR)

(73) Assignee: LG Electronics Inc., Seoul (KR)

( * ) Notice: Subject to any disclaimer, the term of this patent is extended or adjusted under 35 U.S.C. 154(b) by 150 days.

(21) Appl. No.: 10/607,973

(22) Filed: Jun. 30, 2003

(65) Prior Publication Data

US 2004/0101409 A1 May 27, 2004

(30) Foreign Application Priority Data

Nov. 27, 2002 (KR) ..... 10-2002-0074438

(51) Int. Cl.
*F04D 29/38* (2006.01)

(52) U.S. Cl. ..... 416/223 R; 416/DIG. 2; 416/238

(58) Field of Classification Search ..... 415/220, 415/189, 192, 238, DIG. 2, DIG. 5, 169 A, 415/223 R, 243, 288, 228; 416/238, DIG. 2, 416/DIG. 5, 169 A, 223 R, 243
See application file for complete search history.

(56) References Cited

U.S. PATENT DOCUMENTS 4,684,324 A * 8/1987 Perosino ..... 416/189
5,000,660 A * 3/1991 Van Houten et al. ..... 416/203
5,297,931 A * 3/1994 Yapp et al. ..... 415/208.1
5,393,199 A * 2/1995 Alizadeh ..... 416/189
6,113,353 A * 9/2000 Sato et al. ..... 416/232
6,287,078 B1 * 9/2001 Min et al. ..... 416/189
6,325,597 B1 * 12/2001 Kim et al. ..... 416/238
6,394,754 B1 * 5/2002 Choi ..... 416/238
2002/0034443 A1 * 3/2002 Song ..... 416/223 R

FOREIGN PATENT DOCUMENTS

KR 10-2002 0088495 11/2002

OTHER PUBLICATIONS

English language Abstract of KOREA 10–2002–0088495.

* cited by examiner

*Primary Examiner*—Edward K. Look
*Assistant Examiner*—Richard A. Edgar
(74) *Attorney, Agent, or Firm*—Greenblum & Bernstein, P.L.C.

(57) ABSTRACT

Disclosed herein is a cool air circulation type axial flow fan for a refrigerator. The fan comprises a plurality of spaced blades mounted on the outer circumference of a hub for blowing cool air to a freezing chamber and a chilling chamber of the refrigerator. Several important design factors, such as the number of blades, a sweep angle, a pitch angle, a rake angle, a maximum camber position, and a maximum camber ratio of each of the blades, of the fan are optimally determined, whereby a noise generated over a wide frequency band is remarkably reduced. Furthermore, power consumption is reduced with reduction of flow loss.

13 Claims, 8 Drawing Sheets

COOL AIR CIRCULATION TYPE AXIAL FLOW FAN FOR REFRIGERATOR

BACKGROUND OF THE INVENTION

1. Field of the Invention

The present invention relates to a cool air circulation type axial flow fan for a refrigerator which is capable of blowing cool air to a freezing chamber and a chilling chamber, and more particularly to a cool air circulation type axial flow fan for a refrigerator in which several important design factors of the fan can be optimally determined to reduce flow noise over a relatively wide frequency band.

2. Description of the Related Art

Generally, a refrigerator stores foodstuffs in a fresh state for a long time using cool air obtained by a refrigerating cycle. The cool air is used to cool down the foodstuffs or prevent decomposition of the foodstuffs. A cool air circulating fan is disposed in a flow channel through which the cool air is circulated for blowing the cool air to a chilling chamber or a freezing chamber.

FIG. 1 is a side view, in longitudinal section, of a general refrigerator. FIG. 2 is a front view of a conventional cool air circulation type axial flow fan, and FIG. 3 is a side view of the conventional cool air circulation type axial flow fan.

As shown in FIG. 1, the refrigerator basically comprises a outer case 1 having an open front part, an inner case 2 disposed in the outer case 1 and spaced apart from the outer case 2, a chilling chamber A mounted at the upper part in the inner case 2, a freezing chamber B mounted at the lower part in the inner case 2, a machinery chamber C provided below the freezing chamber B, a door 3 pivotably attached at the upper front part to the outer case 1, and another door 4 pivotably attached at the lower front part to the outer case 1.

Between the outer case 1 and the inner case 2 is defined a flow channel, through which the cool air is supplied to the chilling chamber A or the freezing chamber B. In the flow channel at the freezing chamber B is mounted an evaporator 5 for producing the cool air by heat exchange with atmospheric air. In the flow channel above the evaporator 5 is mounted a blower 10 for upwardly blowing the cool air having passed through the evaporator 5.

In the machinery chamber C are mounted a compressor 6 connected to the evaporator 5 via a refrigerant pipe, a condenser (not shown), and an expander (not shown), which constitute together a refrigerating cycle to generate the cool air. The resulting cool air is supplied to the chilling chamber A or the freezing chamber B. Consequently, the chilling chamber A or the freezing chamber B are maintained at low temperatures, respectively.

The blower 10 includes an axial flow fan 12 attached to a rotating shaft of a motor for blowing the cool air. As shown in FIG. 2, the axial flow fan 12 comprises a hub 12*a* attached to the motor via the rotating shaft of the motor, and four spaced blades 12*b* mounted on the outer circumference of the hub 12*a*.

Each of the blades 12*b* has a leading edge LE facing the direction of rotation, a trailing edge TE opposite to the leading edge, a blade tip BT connected between the outer ends of the leading and trailing edges LE and TE, and a blade hub BH connected to the hub 12*a*.

Each of the blades 12*b* also has a front surface P to which a pressure created by the introduced cool air is applied (hereinafter referred to as a positive pressure surface P), and a rear surface D opposite to the positive pressure surface P (hereinafter referred to as a negative pressure surface D).

Each of the blades 12*b* is formed in such a manner that a sweep angel $\alpha$ of each of the blades 12*b* is relatively small, for example, approximately 25 degrees.

The sweep angle $\alpha$ indicates the degree in which each of the blades 12*a* is inclined from the radius of the fan toward the direction of rotation. Specifically, the sweep angle $\alpha$ is an angle defined between a line connecting the center of the blade hub BH to the center of the blade tip BT and an extension of another line connecting the center of the hub 12*a* to center of the blade hub BH.

When the conventional cool air circulation type axial flow fan 12 with the afore-stated construction is operated by means of the motor, the sweep angle $\alpha$ is relatively small. Consequently, a sufficient strong cool air flow suitable for a large pressure loss occurring across a complex flow channel in a large-sized refrigerator is not created. Furthermore, the cool air flow advances in the axial direction of the fan with the result that noise is increased.

SUMMARY OF THE INVENTION

Therefore, the present invention has been made in view of the above problems, and it is an object of the present invention to provide a cool air circulation type axial flow fan for a refrigerator in which several important design factors, such as the number of blades, a sweep angle of each of the blades, etc., of the fan can be optimally determined to create a sufficiently strong cool air flow suitable for a large pressure loss occurring across a complex flow channel in the refrigerator, and reduce noise.

In accordance with the present invention, the above and other objects can be accomplished by the provision of a cool air circulation type axial flow fan for circulating cool air in a refrigerator, comprising a hub connected to a motor via a rotating shaft of the motor, and a plurality of spaced blades 12*b* mounted on the outer circumference of the hub, wherein the number of the blades is set to between 6 and 8, and each of the blades has a sweep angle of between 50 and 65 degrees.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
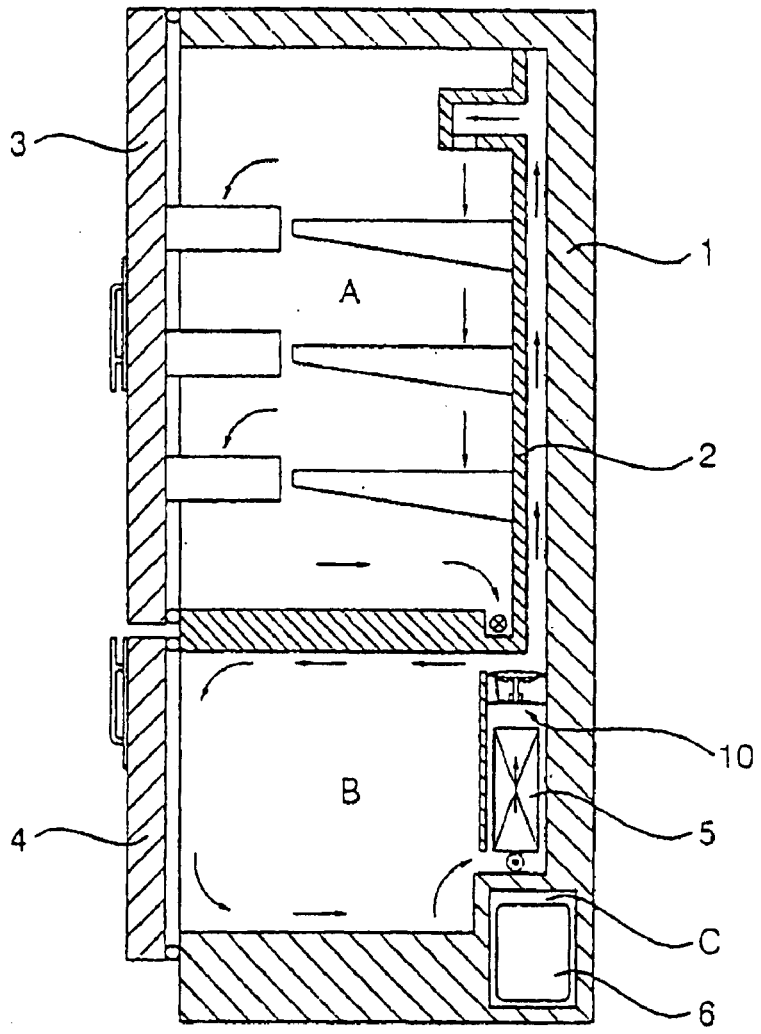
FIG. 1(Prior Art)
FIG. 1 is a side view, in longitudinal section, of a general refrigerator.
Figure 2:
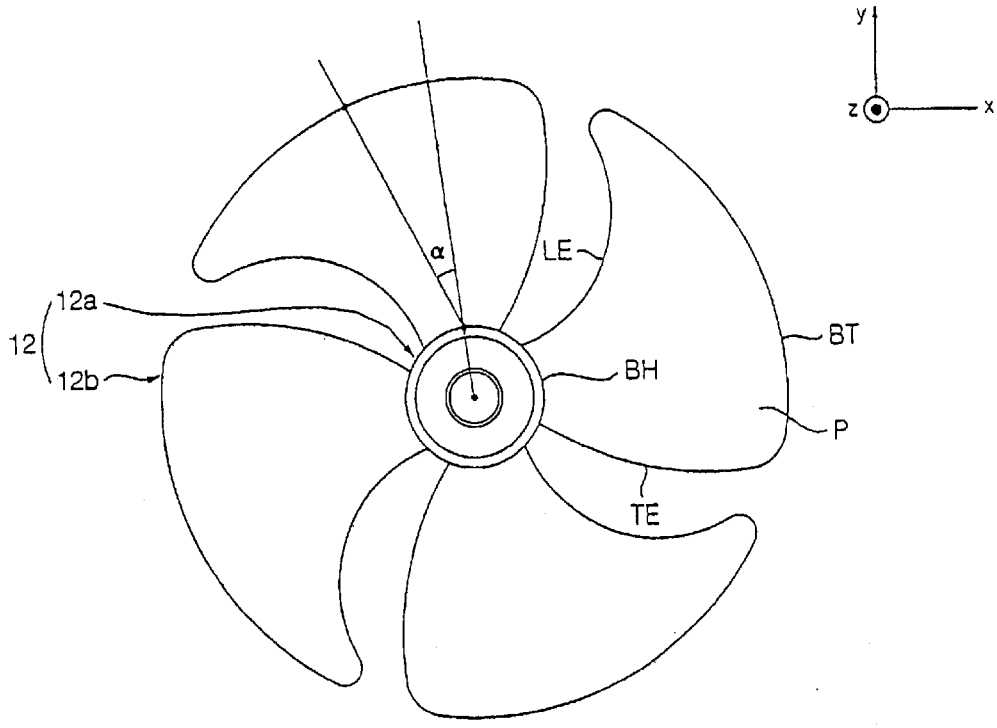
FIG. 2(Prior Art)
FIG. 2 is a front view of a conventional cool air circulation type axial flow fan.
Figure 3:
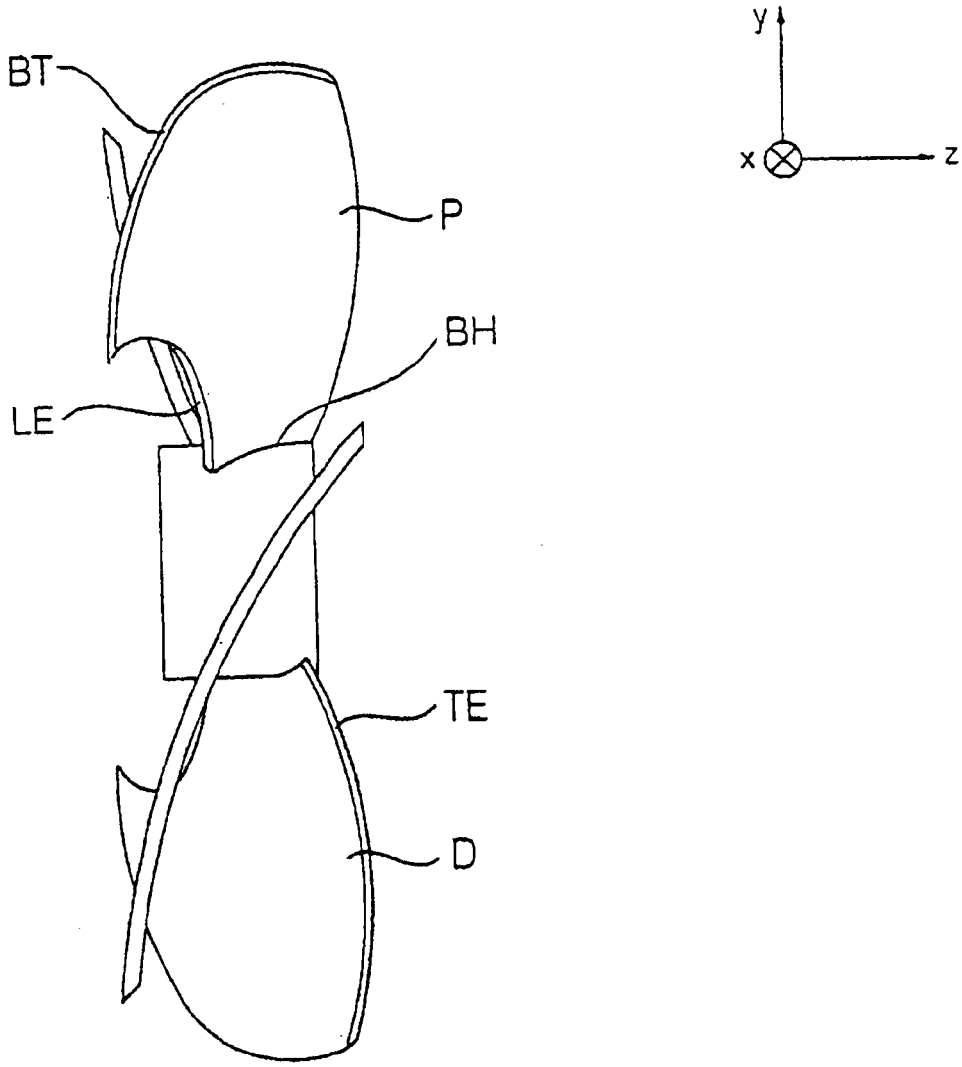
FIG. 3(Prior Art)
FIG. 3 is a side view of the conventional cool air circulation type axial flow fan.
Figure 4:
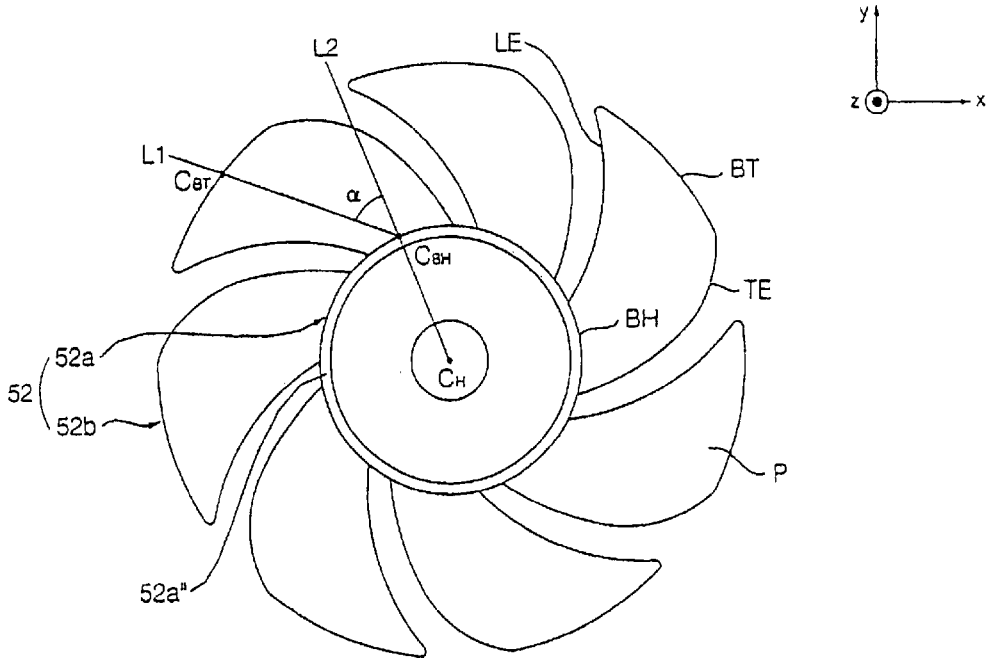
FIG. 4 is a front view of a cool air circulation type axial flow fan according to the present invention.
Figure 5:
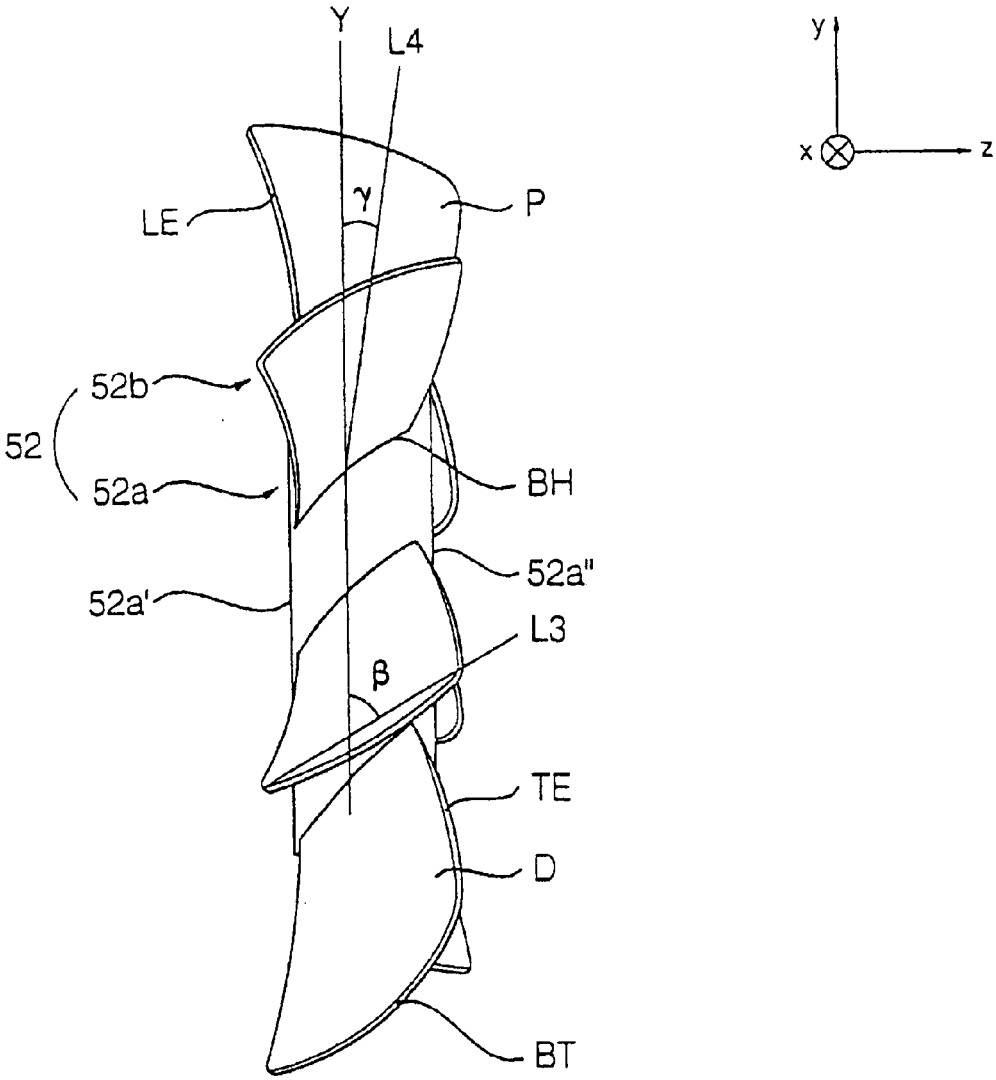
FIG. 5 is a side view of the cool air circulation type axial flow fan according to the present invention.
Figure 6:
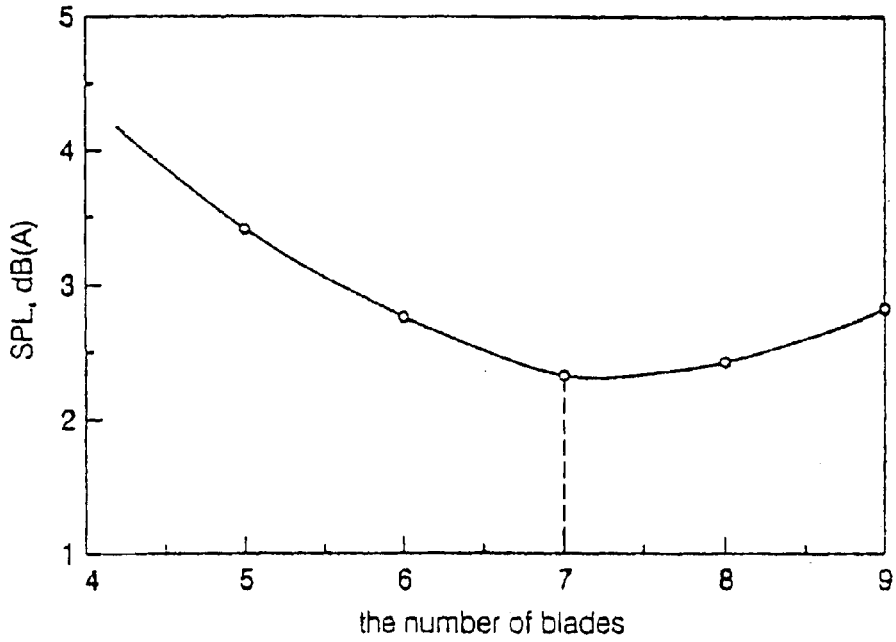
FIG. 6 is a graph illustrating relations between noise levels and the number of blades of the cool air circulation type axial flow fan according to the present invention.
Figure 7:
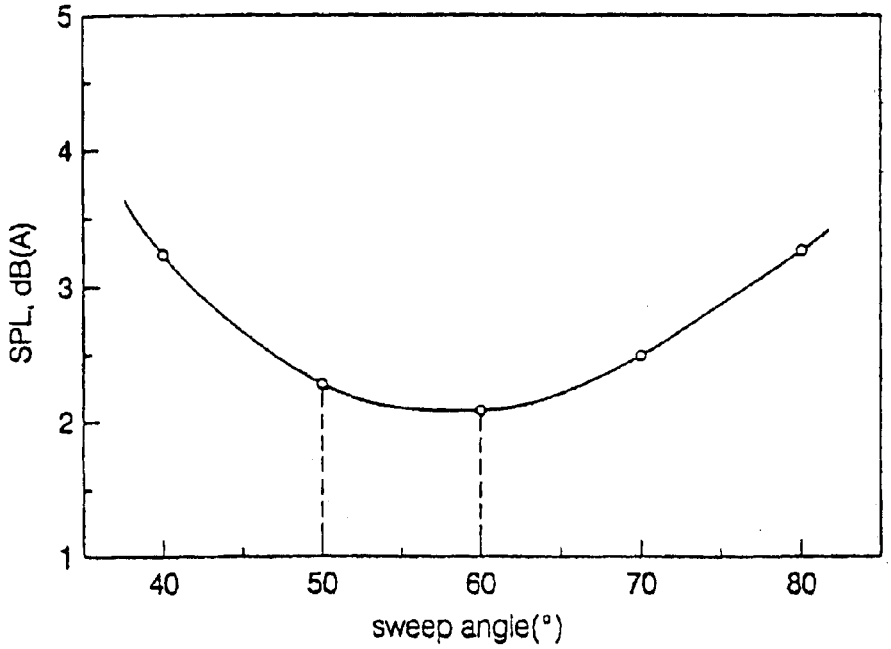
FIG. 7 is a graph illustrating relations between noise levels and sweep angles of the cool air circulation type axial flow fan according to the present invention.

FIG. 4 is a front view of a cool air circulation type axial flow fan according to the present invention, and FIG. 5 is a side view of the cool air circulation type axial flow fan according to the present invention. FIG. 6 is a graph illustrating relations between noise levels and the number of blades of the cool air circulation type axial flow fan according to the present invention, and FIG. 7 is a graph illustrating relations between noise levels and sweep angles of the cool air circulation type axial flow fan according to the present invention.

Figure 8:
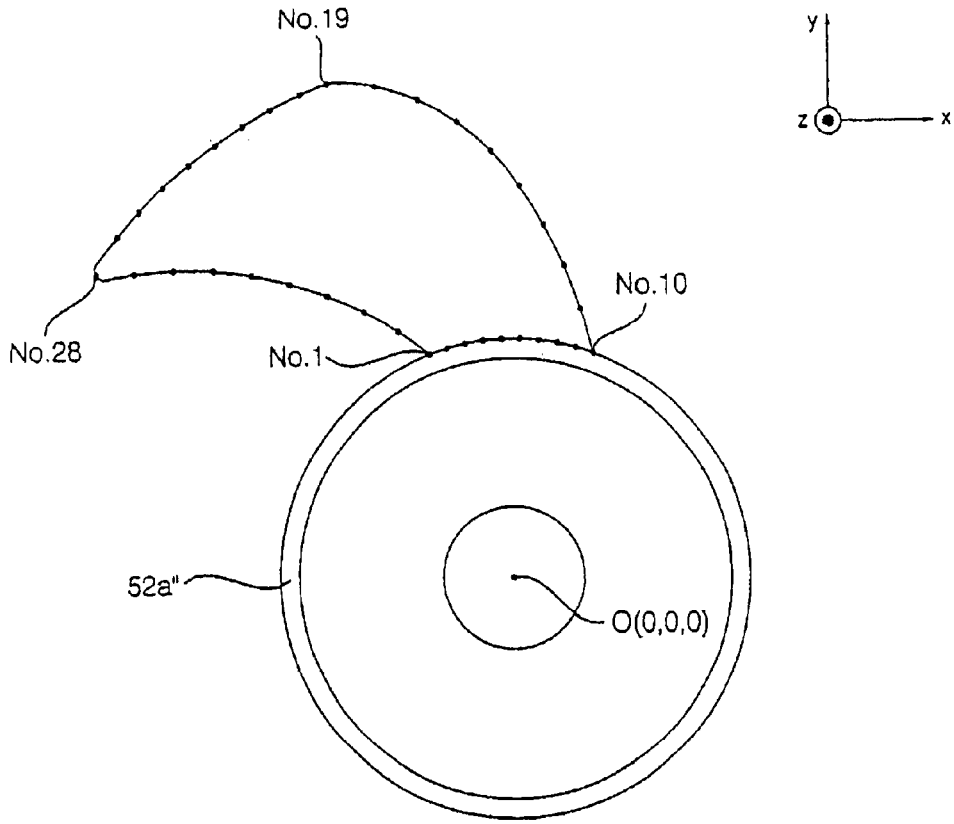
FIG. 8 is a partial front view of a preferred embodiment of a blade, which is formed by blade boundary data of the cool air circulation type axial flow fan according to the present invention.
Figure 9:
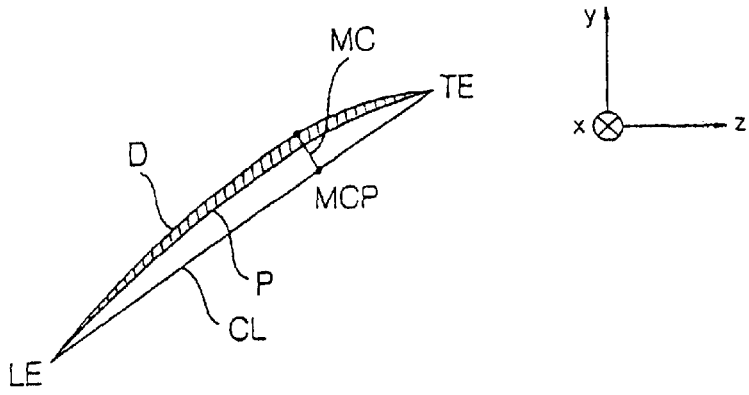
FIG. 9 is a view illustrating a maximum camber position of the blade of the cool air circulation type axial flow fan according to the present invention.
Figure 10:
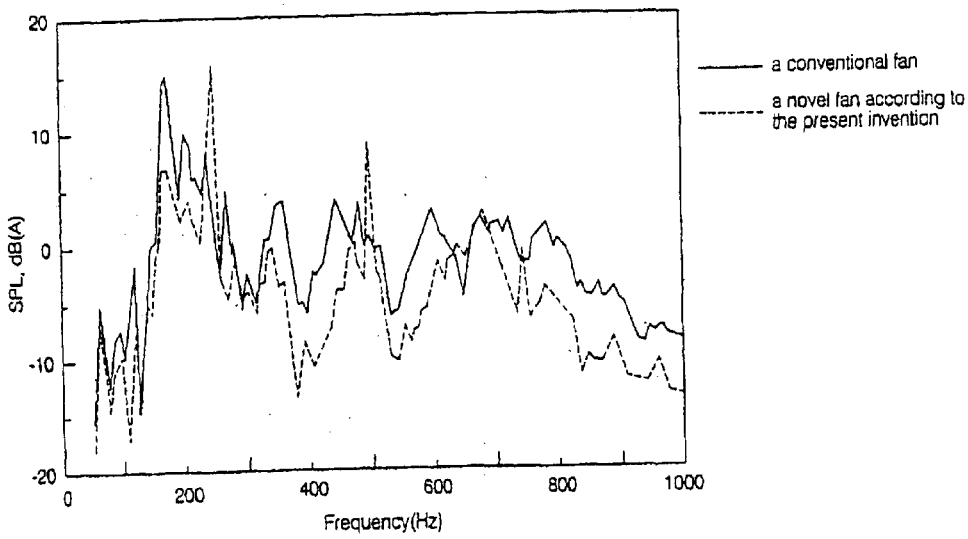
FIG. 10 is a graph illustrating relations between noise levels and frequencies of the cool air circulation type axial flow fan according to the present invention.

FIG. 8 is a partial front view of a preferred embodiment of a blade, which is formed by blade boundary data of the cool air circulation type axial flow fan according to the present invention, FIG. 9 is a view illustrating a maximum camber position of the blade of the cool air circulation type axial flow fan according to the present invention, and FIG. 10 is a graph illustrating relations between noise levels and frequencies of the cool air circulation type axial flow fan according to the present invention.

As shown in FIGS. 4 and 5, the cool air circulation type axial flow fan according to the present invention comprises a hub 52*a* attached to a rotating shaft 20 of a motor. The hub 52*a* is formed in the shape of a cylinder. The hub 52*a* has a front surface 52*a*' and a rear surface 52*a*" having the same diameter as the front surface 52*a*'. On the outer circumference of the hub 52*a* are mounted between 6 and 8 spaced blades 52*b*. Preferably, the number of the blades 52*b* is 7.

Each of the blades 52*b* has a leading edge LE into which the cool air is introduced, a trailing edge TE opposite to the leading edge, a blade tip BT connected between the outer ends of the leading and trailing edges LE and TE, and a blade hub BH connected to the hub 52*a*.

Each of the blades 52*b* also has a front surface P to which a pressure created by the introduced cool air is applied (hereinafter referred to as a positive pressure surface P), and a rear surface D opposite to the positive pressure surface P (hereinafter referred to as a negative pressure surface D).

Each of the blades 52*b* is formed in such a manner that the trailing edge TE is disposed closer to the rear surface 52*a*" of the hub 52*a* than the leading edge LE to provide prescribed curvature between the leading edge LE and the trailing edge TE.

Each of the blades 52*b* is also formed in such a manner that a sweep angle α, which is an angle defined between a first line L1 connecting the center $C_{BH}$ of the blade hub BH to the center $C_{BT}$ of the blade tip BT and an extension of a second line L2 connecting the center $C_H$ of the hub 12*a* to center $C_{BH}$ of the blade hub BH, is set to between 50 and 65 degrees, preferably 51°±1°.

The aforesaid axial flow fan 52 is rotated counterclockwise when seen from the positive pressure surface P.

The inventor of the present invention have performed several experiments for determining design factors having an effect on noise generated by the axial flow fan 52, and come to the conclusion that the design factors having a relatively large effect on noise include the number of blades and a sweep angle of each of the blades.

Measurement of noise levels based on the different number of blades has been made while other design factors of the fan have been constant. The result is that the lowest noise is generated in the axial flow fan having seven blades, as shown in FIG. 6. On the other hand, measurement of noise levels based on different sweep angles has been made while other design factors of the fan have been constant. The result is that the lowest noise is generated in the axial flow fan having a sweep angle α of between 50 and 65 degrees, as shown in FIG. 7.

In conclusion, noise is minimized under a condition that a sweep angle α of the axial flow fan is set to between 50 and 65 degrees and the number of blades of the axial flow fan is 7.

Preferably, the blades 52*b* of the axial flow fan 52 according to the present invention may be formed in such a manner that one of the blades 52*b* has boundary data, as indicated in Table 1, at every 10 points on the blade hub BH, the trailing edge TE, the blade tip BT, and the leading edge LE on the assumption that the center of the hub 52 on the rear surface 52*a*" of the hub 52 is the starting point (0, 0, 0) as shown in FIG. 8.

TABLE 1

| | Boundary data of a blade | | |
|---|---|---|---|
| No | X | Y | Z |
| 1 | −6.818 | 19.333 | −5.721 |
| 2 | −6.344 | 19.494 | −5.382 |
| 3 | −5.055 | 19.867 | −4.421 |
| 4 | −3.152 | 20.256 | −3.014 |
| 5 | −0.861 | 20.482 | −1.316 |
| 6 | 1.560 | 20.441 | 0.480 |
| 7 | 3.783 | 20.148 | 2.244 |
| 8 | 5.440 | 19.765 | 3.935 |
| 9 | 6.462 | 19.455 | 5.218 |
| 10 | 6.818 | 19.333 | 5.721 |
| 11 | 3.564 | 26.452 | 4.197 |
| 12 | 0.702 | 32.147 | 3.047 |
| 13 | −2.539 | 36.801 | 1.642 |
| 14 | −6.290 | 40.408 | −0.104 |
| 15 | −10.503 | 42.906 | −2.306 |
| 16 | −14.461 | 44.428 | −4.977 |
| 17 | −17.579 | 45.249 | −7.567 |
| 18 | −20.171 | 45.352 | −10.768 |
| 19 | −21.193 | 45.286 | −13.063 |
| 20 | −21.822 | 44.987 | −13.317 |
| 21 | −23.625 | 44.067 | −14.980 |
| 22 | −26.463 | 42.423 | −17.016 |
| 23 | −30.064 | 39.952 | −18.629 |
| 24 | −33.692 | 36.944 | −20.037 |
| 25 | −36.862 | 33.781 | −21.348 |
| 26 | −39.307 | 30.902 | −22.337 |
| 27 | −40.866 | 28.809 | −22.736 |
| 28 | −41.419 | 28.088 | −22.599 |
| 29 | −41.245 | 27.615 | −22.566 |
| 30 | −40.352 | 26.984 | −22.285 |
| 31 | −37.988 | 27.200 | −21.336 |
| 32 | −34.702 | 27.332 | −19.245 |
| 33 | −30.397 | 27.357 | −17.986 |
| 34 | −24.991 | 27.134 | −15.308 |
| 35 | −18.999 | 25.941 | −12.216 |
| 36 | −13.088 | 23.262 | −9.157 |
| 37 | −6.818 | 19.333 | −5.721 |

At this time, the sweep angle α of each of the blades 52*b* is 50 degrees. Each of the blades 52*b* is linearly formed in such a manner that pitch angles β at the blade hub BH and the blade tip BT are 40 degrees and 31.5 degrees, respectively. Also, a rake angle r γ of 21 degrees is formed on the positive pressure surface P.

Of course, it should be noted that the sweep angle α, the pitch angle β, and the rake angle r γ may have prescribed allowable ranges, preferably within a range of 1 degree, respectively.

The pitch angle β is an angle defined between a line of a vertical axis Y, which is parallel to another vertical axis y, and a third line L3 connected from the leading edge LE to the trailing edge TE. The rake angle r γ is an angle defined between the line of the vertical axis Y, which is parallel to the vertical axis y, and a fourth line L4 intersecting the blade hub BH and the blade tip BT.

Each of the blades 52*b* is also formed in such a manner that a maximum camber position MCP is uniformly distributed from the blade hub BH to the blade tip BT. The maximum camber position MCP is 0.7 on the assumption that positions of the leading and trailing edges LE and TE are 0 and 1, respectively.

At this time, a maximum camber ratio is also uniformly distributed from the blade hub BH to the blade tip BT. The maximum camber ratio is 7.0%. The maximum camber ratio may be changed from 6.0% to 8.0%.

The maximum camber position MCP indicates the point of each of the blades 52*b* farthest from a chord line CL, which is a line connected between the leading edge LE and the trailing edge TE, and the maximum camber ratio indicates the ratio in percentage of a maximum camber length MC, which is a distance between the chord line CL and the maximum camber position MCP of each of the blades 52*b*, to the length of the chord line CL.

In comparison of a novel fan having seven blades with a sweep angle of 50 degrees according to the present invention to a conventional fan having for blades with a sweep angle of 25 degrees, the novel fan generates remarkably less noise over a wide frequency band as compared to the conventional fan, as shown in FIG. 10. Furthermore, the novel fan generates noise over 4.5 dB(A) lower than the conventional fan in case that the flow rates of the novel and conventional fans are the same.

Consequently, it is easily understandable that flow loss is also reduced with reduction of the noise in the fan according to the present invention, and thus power consumption is reduced under the condition of the same air flow.

As apparent from the above description, the present invention provides a cool air circulation type axial flow fan for a refrigerator in which several important design factors, such as the number of blades, a sweep angle of each of the blades, etc., of the fan can be optimally determined to create a sufficiently strong cool air flow suitable for a large pressure loss occurring across a complex flow channel in the refrigerator in case that the axial flow fan according to the present invention is disposed in a flow channel of the refrigerator, whereby noise generated over a wide frequency band is remarkably reduced. Furthermore, power consumption is reduced under the condition of the same air flow as flow loss is reduced, and reliability of the refrigerator is further improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cool air circulation type axial flow fan that circulates cool air in a refrigerator, comprising:

a hub connected to a motor via a rotating shaft of the motor; and a plurality of spaced blades mounted on the outer circumference of the hub, wherein the number of the blades is set to between 6 and 8, and each of the blades has a sweep angle of between 50 and 65 degrees.

2. The fan as set forth in claim 1, wherein the fan is rotated counterclockwise when seen from a positive pressure surface of each of the blades.

3. The fan as set forth in claim 2, wherein the number of the blades is 7.

4. The fan as set forth in claim 3, wherein the sweep angle is 51°±1°.

5. The fan as set forth in claim 4, wherein each of the blades has a pitch angle, the pitch angle being larger at a blade hub of each of the blades than at a blade tip of each of the blades.

6. The fan as set forth in claim 5, wherein the pitch angle is linearly reduced from the blade hub of each of the blades to the blade tip of each of the blades.

7. The fan as set forth in claim 6, wherein the pitch angle is 40°±1° at the blade hub of each of the blades, and 31.5°±1° at the blade tip of each of the blades.

8. The fan as set forth in claim 4, wherein each of the blades has a prescribed rake angle γ formed on the positive pressure surface of each of the blades.

9. The fan as set forth in claim 8, wherein the rake angle is 21°±1° on the positive pressure surface of each of the blades.

10. The fan as set forth in claim 4, wherein each of the blades has a maximum camber position, the maximum camber position being uniformly distributed from the blade hub of each of the blades to the blade tip of each of the blades.

11. The fan as set forth in claim 10, wherein the maximum camber position is 0.7 on the assumption that positions of a leading edge of each of the blades and a trailing edge of each of the blades are 0 and 1, respectively.

12. The fan as set forth in claim 10, wherein each of the blades has a maximum camber ratio, the maximum camber ratio being uniformly distributed from the blade hub of each of the blades to the blade tip of each of the blades.

13. The fan as set forth in claim 11, wherein the maximum camber ratio is 7.0±1%.

* * * * *